United States Patent [19]

Richardson

[11] 4,239,261

[45] Dec. 16, 1980

[54] MICRO-MARKING LABEL AND APPARATUS

[76] Inventor: Robert H. Richardson, 8361 Sylvan Dr., Melbourne, Fla. 32901

[21] Appl. No.: 936,241

[22] Filed: Aug. 24, 1978

[51] Int. Cl.[3] ..... G09F 3/03

[52] U.S. Cl. ..... 283/21; 283/1 R; 40/2 R

[58] Field of Search ..... 283/1, 18, 56, 21; 40/2 R

[56] References Cited

U.S. PATENT DOCUMENTS

| | | | |
|---|---|---|---|
| 3,211,470 | 10/1965 | Wilson | 283/18 |
| 3,552,853 | 1/1971 | Sanders et al. | 40/2 R X |
| 3,632,995 | 1/1972 | Wilson | 283/56 X |

*Primary Examiner*—Paul A. Bell
*Attorney, Agent, or Firm*—Richard D. Dixon

[57] ABSTRACT

The present invention relates to a micro-marking label to be applied to an article for identification. The label is formed from a thin microsized plate of generally transparent material which includes a marking indicia thereon. The indicia is divided into a plurality of digital areas each of which are homogeneously marked in either a first or second optical condition so as to identify a digital bit of data. The label is placed upon a surface of the article to be identified and sealed thereto by a layer of sealant which is substantially larger than the microsized label. An apparatus for depositing the label is also included.

6 Claims, 6 Drawing Figures

FIG. 1
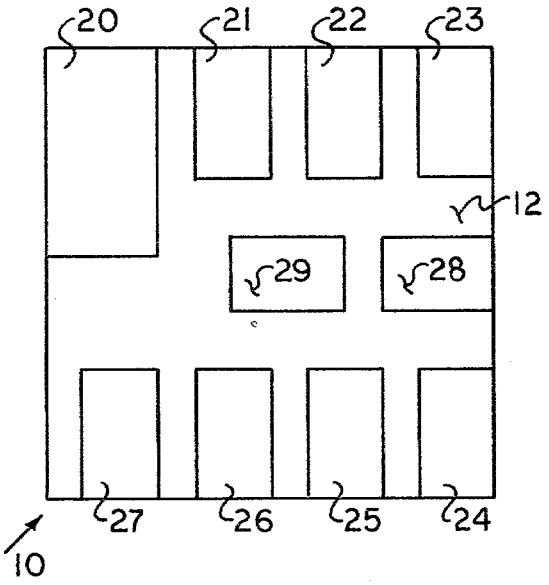
FIG. 2
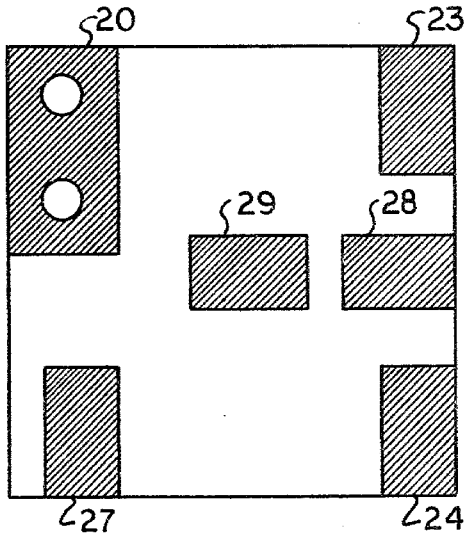
FIG. 3
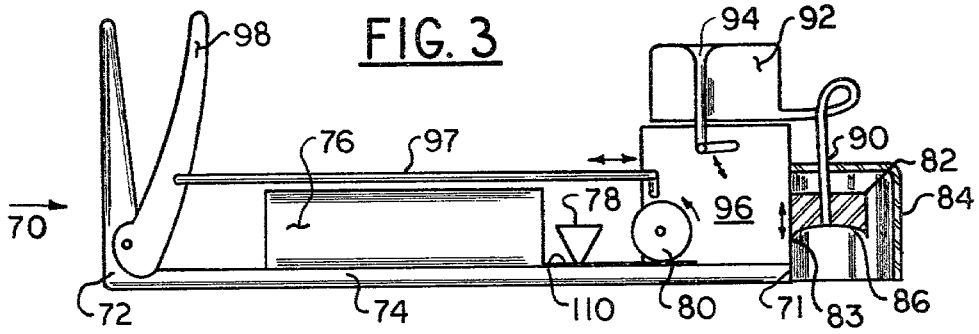
FIG. 5
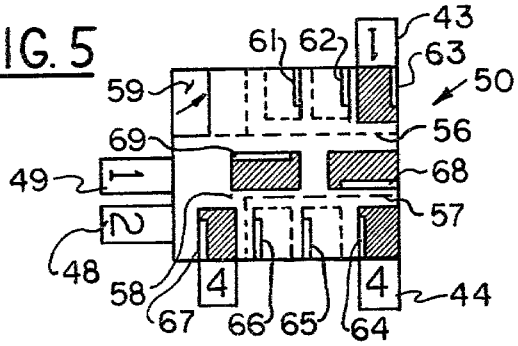
FIG. 6
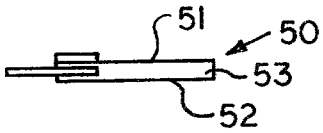
FIG. 4
| CODE AREA | 20 | 21 | 22 | 23 | 24 | 25 | 26 | 27 | 28 | 29 |
|---|---|---|---|---|---|---|---|---|---|---|
| WEIGHTED VALUE | 1 | 4 | 2 | 1 | 4 | 2 | 1 | 4 | 2 | 1 |
| BINARY (FIG. 2) | 1 | 0 | 0 | 1 | 1 | 0 | 0 | 1 | 1 | 1 |
| DECODED VALUE | 1 | – | 1 | – | – | 4 | – | – | 7 | – |

MICRO-MARKING LABEL AND APPARATUS

BACKGROUND OF THE INVENTION

I. Field of the Invention

This invention relates to a system, apparatus and method for permanently attaching a coded marker to an article to be identified. More specifically, the invention relates to an optical marker which is digitally coded to represent the part identification number, owner identification number or other information required to be associated with the particular article in question.

II. Description of the Prior Art

As mechanical and electrical systems become more complex, and as theft becomes more of a concern to cost conscious owners, it becomes imperative that a simplified, economical and rapid application marking system be developed in order to identify specific parts either from each other or as to the ownership of a group of parts. It is also strongly desirable that this marking system not be easily visible to the casual observer. Instead the system should be easily visible only to a person with the proper decoding or vision equipment so that quick identification of the part may be established. In this manner the identification marker may be attached to the item in a hidden or nonobvious position which will deter potential pilferage due to the uncertainty as to the fact that the item has been marked or as to the exact location of the marking.

The marking system must be permanent in nature in order that it may not be removed easily from the item. Furthermore the marking system must be inexpensive and easily attached to the item so that the cost of marking each item does not economically outweigh the advantages obtained by having the item marked. The format of the marker must be flexible enough to contain one of a large number of codes, preferably at least one-thousand possible codes, and yet the marker must be very small in order that it may be concealed or hidden from obvious recognition. It is also desirable that the marker contain coded identifications which will require some ambiguous or unknown decoding in order to prevent the untrained observer from identifying the coded information.

The present inventor is unaware of any item or system which will meet the requirements as set forth above. One system which has been examined and discarded as not suitable for application in this regard is the system manufactured and marketed by The Minnesota Mining and Manufacturing Corporation under the trademark MICROTAGGANTS. This system utilizes markers of very small dimensions which are formed by laminating a plurality of color coded plastic sheets together to form a relatively thin plate. The sheets are laminated under pressure with an adhesive in order to form a rigid structure. The edges of this structure are broken or fractured generally at an acute angle with either the top or planar surfaces thereof. The angled edge or side surfaces therefore reveal a sequence of multi-colored layers which may be coded according to color in order to identify a specific lot number, part number or other information of value.

These small markers are approximately the size of a grain of sand and are therefore somewhat difficult to read, normally requiring a one hundred power reading device. Since the colors represent the information contained in the marker, a color coded conversion table must be consulted in order to visually decode the information contained therein. These markers may be suspended in an applicating solution which is attached to the item to be marked or in the alternative may merely be mixed within the substance comprising the items to be identified. For example, this marker has been mixed with gun powder in order to provide positive identification as to the manufacturer and lot number of the explosive. This information provides a method for tracing the subsequent use of explosives and gun powder.

Another marking system which has been examined and discarded as unsuitable is the visual marking systems in which an alpha-numerica code or series of vertically oriented and width modulated lines are read by a visual detection device and digitally decoded in order to represent the alpha-numeric information contained therein. Typically these markers are of substantial size and therefore are unsuitable for satisfying the above-mentioned requirements. In addition, expensive detection and decoding equipment is required in order to obtain the information coded upon the marker. Thus, this type of system is not suitable for application to an extremely large number of items to be identified, especially when decoding of the marker must be made in geographically remote or environmentally difficult conditions.

A further marking system which appears to be unsuitable utilizes magnetically encoded marker devices. These systems and devices share the same problems as previously mentioned, mainly that a complex and expensive decoding system must be provided for reading the information contained on the marker. Furthermore, when the magnetic marking systems are exposed to inclement weather and environmentally difficult conditions, the marker may be partially desensitized or demagnetized resulting in the loss of some information. This problem is especially acute when the marker is exposed to extremely cold or hot weather conditions or is exposed to extended periods of irradiation by ultraviolet light. These items and systems are actually subclasses of a larger group of general pattern recognition systems which are oriented towards military applications. While this technology is suitable for the present requirements, the economic expense which would be encountered in implementing such a system on a large scale far outweigh the economic advantages obtained through marking the items.

Previously issued U.S. patents have also been examined in order to determine if a suitable system has been developed by other inventors. For example, Heegaard, in U.S. Pat. No. 3,950,870, discloses a microidentification label having an adhesive backing for coupling to the article to be identified. The label includes an alphanumeric indicia thereon which is too small to be read by the unaided eye. A plurality of these labels are attached to a master card, and are punched out through the use of a special tool in order to apply them to the article to be marked. A fluorescent agent is added to the adhesive so as to be illuminated with the illumination of black light. While the label is relatively small in size, the indicia upon the label may be easily decoded by an untrained or unauthorized person by the use of a simple magnifying glass. Thus, many of the covert and highly sensitive uses of this label are precluded due to the ease of unauthorized decoding.

Another label having a pressure sensitive adhesive layer on the backside thereof is disclosed by Aoyagi, in U.S. Pat. No. 4,032,679. This label is large and therefore unsuitable for covert uses. Fukuda, in U.S. Pat. No. 3,961,956, discloses a label having an indicia including special printed information which may only be decoded through the use of a matching lenticular lense. While this label will protect from unauthorized decoding the information contained therein, it nevertheless requires a complex and expensive decoder in order to obtain any information from the label.

Various holographic labels have been developed in the prior art. The disclosures of Ward, in U.S. Pat. No. 3,894,756, and Sanders, in U.S. Pat. No. 3,552,853, are typical of the holographically decoded labels. Wilson, in U.S. Pat. No. 3,211,470, discloses a label printed upon paper which is adhesively fastened to the article to be identified. While the digital coding on this label precludes an authorized person from obtaining the information contained thereon, the coded indicia is so complicated that it must be decoded through the use of an expensive and complicated digital machine.

The prior art also reflects various stages of development for applicators designed to apply labels to articles to be identified. Typical examples of these large and bulky label applicators are disclosed by Kronman, in U.S. Pat. No. 2,891,692, Penney, in U.S. Pat. No. 1,812,980, and Putnam, in U.S. Pat. No. 1,648,590. While some of these references employ the use of a sprayable or spreadable adhesive for attaching the label to the article to be identified, none of these references are suitable for modifications which would be required in order to successfully apply microsized labels to the articles to be identified.

The present inventor has examined each of these approaches and in turn has discarded the use of these systems for the reasons as set forth above. Instead the present system concentrates on the basic requirements as previously explained. In order to uniquely identify an article, some unique or repeatable characteristic of the article or marker must be identified and sensed, such as through the use of visual light, x-rays, infrared, ultrasonic, etc. The most economically effective way of establishing such repeatable characteristics is to attach a customized marker to the item to be identified. The use of complicated coding and sensing equipment is discouraged for economic reasons. The use of skilled labor is also discouraged for economic reasons.

One additional problem represented in marking an item is that if a marker is to be attached to an item, it can also be removed surreptitously from the item. In view of these restrictions it becomes apparent that the marker must be attached in some covert manner in order to be completely successful. The marker must be easily coded and decoded and attached to the article in such a manner that it is not readily visible except to an educated observer. In this manner any covert attack upon the article in an attempt to remove the marker must be predicted upon the knowledge of the exact location of the marker on the article. Furthermore, the lack of knowledge as to the exact location of the marker can itself act as a deterrent to the potential theft or illegal use of the article, even if the article is not itself marked.

In view of these limitations the present invention envisions the use of a small microdot marker that is digitally coded in order to be visually decoded with the aid of a sharp eye or a small magnifying glass or microscope.

The problem of coding and decoding has been attacked under the presumption that a large number of the markers must be economically reproduced and attached to an equally large number of items to be marked. The present system envisions the use of high volume photoreduction techniques for manufacturing the markers. In this manner the coding may be accomplished on a large scale and then reduced to the necessary size. For the sake of economy it is advisable to produce a large sheet of identical codes and then to reduce the entire sheet to usable sizes. This will result in a relatively large number of markers being present upon the same basic master or reproduced item. Empirical experiments have indicated that a marker size of approximately 0.03 inches by 0.03 inches is satisfactory. Digital and alpha-numeric markings on markers of this size are easily readable through the use of a ten-power pocket magnifier or microscope, but in absence of such visual assistance the devices can be read with the naked eye, albeit with some difficulty. Of course, the size of the marker can be varied in order to determine the specific requirements of a particular application.

SUMMARY OF THE INVENTION

The present invention relates to an apparatus for marking articles to be identified. The apparatus includes a member having thereon a plurality of microsized labels, with each of the labels including an optically coded identification indicia. Each of the labels is sufficiently small in size so as to be substantially invisible to the casual observer when mounted on the article to be identified. Separating means are provided for segregating at least one of the labels from the larger member and placing the label onto the article to be identified. Sealing means are provided for depositing a thin layer of a transparent sealing solution over the label and the adjacent surface of the article to be identified.

BRIEF DESCRIPTION OF THE DRAWINGS

Other objects, features and advantages will become apparent through a study of the written description and the drawings in which:

FIG. 1 illustrates a top view of a first preferred embodiment of a marker in accordance with the present invention.

FIG. 2 illustrates a top view of a coded example of a first preferred embodiment of the present invention.

FIG. 3 illustrates a frontal view of a first preferred embodiment of an apparatus for applying the marker in accordance with the present invention.

FIG. 4 illustrates a sample matrix decoding exercise with regard to the marker illustrated in FIG. 2.

FIG. 5 illustrates a top elevational view of a just preferred embodiment of a manual decoder in accordance with the present invention.

FIG. 6 illustrates a side view of the manual decoder.

DETAILED DESCRIPTION OF THE PREFERRED EMBODIMENT

A first preferred embodiment of the present invention will be described as one specifically designed for a system of markers which require up to 1023 or ($2^n$-1) different coding characters. It will of course be understood that the general size and shape of the marker may be varied in order to accommodate additional digits, codes or characters without departing from the spirit or scope of the present invention. It is specifically envisioned that this type of marker may be used on large construction projects, such as the Transcontinental Pipeline. Each marker would designate a specific work station or work location to which machinery, supplies and construction materials are shipped for use on the construction project. Each station could be assigned its own specific identification code number in order to assure that materials received at or designated for a specific work location are not removed or diverted to an alternate work location. The problem of theft, pilferage and multiple resale of machinery and construction supplies was rampant in previous large scale pipeline construction projects, and the present invention is designed as a covert means of solving these problems.

With specific reference to FIG. 1, a first preferred embodiment of a marker or label in accordance with the present invention is illustrated generally as 10. The marker 10 is formed from a thin plate of generally clear plastic or mylar material which is typically transparent, although the material may be tinted with a specific color if required. The typical thickness of the material is approximately 1 to 2 mills, and the over all dimensions of the marker are approximately 0.0286 inches by 0.0286 inches in order that approximately 35 of the markers may be arranged per linear inch of material. The precise dimensions of the marker may be adjusted in order to more adequately fulfill the space requirements or to eliminate optical resolution or optical definition limitations of photo reproduction equipment. However, the marker 10 should never be large enough or colored so as to be easily visible to the naked eye.

The area of the marker includes thereon an identification indicia which is divided into segregated digital areas or zones into which appropriate homogeneous or digital markings are placed in order to designate a specific code which will identify the object. The first preferred embodiment of the present invention presumes that the base material 12 of the marker 10 is transparent while the zones are marked homogeneously with an opaque color to indicate the presence of a digital "one" in that location. As illustrated in FIG. 1, the first preferred embodiment of the present invention includes a key zone 20 which is present on each coded marker 10 regardless of the coded designation thereon, and then a plurality of digital zones shown as 21, 22, 23, 24, 25, 26, 27, 28 and 29. The location of each of these zones has been chosen with regard to a specific and symmetrical pattern. The symmetry of this pattern will generally prevent one having only a general knowledge of the working of the code from interpreting the information therein. The symmetry will mask the weight of the coded alpha-numeric markings for inhibiting such unauthorized persons in-accurately decoding the indicia without a detailed and specific understanding of the code. The coded areas 21 through 29 are generally all equal in area, with the size of these coded areas being generally equivalent to twice the spaces between adjacent and parallel aligned coded areas. The general size of coded area 22 is generally equal to twice the area between either coded area 22 and 21 or coded area 22 and 23. Likewise, the separation between the coded areas 28 and 29 and their adjacent coded areas is generally equal to or slightly larger than the previously described separation distances. All separation distances are determined by limitations on the optical resolution of the manufacturing techniques and the visual decoding process. Other more limited separation distances may be chosen with a concommitant penalty of increased fabrication expense and increased cost of the decoding equipment. The specific shapes and relative locations of these coded areas may also be varied.

Each of the coded areas is assigned a weighting factor which generally corresponds to the exponent of the base 2. Typically these coded areas are then associated in groups of three in order to form an octal coding system. An example of the use of the coded areas in order to represent an octally encoded number will be explained with reference to FIGS. 1, 2 and 4. With specific reference to FIG. 2, the key slot or key coded area 20 has been darkened with an opaque paint or ink, as have been the coded areas designated as 23, 24, 27, 28 and 29. As illustrated in FIG. 4, a binary "one" has been placed in the column corresponding to the designated coded areas. Binary zeros have been placed in all columns corresponding to the coded areas which are not covered with the opaque material or ink. The coded areas having the numbers 21, 22 and 23 have been grouped into an octal coding unit, as have the coded areas 24, 25 and 26, and the coded areas 27, 28 and 29. When the binary numbers are multiplied by their associated weighted values for each of the coded areas (as designated in FIG. 4 for each of the columns), and then the resulting values are added for each of the three groups, a decoded value is determined. This decoded value is listed in the appropriate row for each of the groups of coded areas. Reading from left to right in the decoded row gives the total decoded value of the marker 10, as shown in FIG. 2, as the decimal number "1147". In the same manner it is possible to darken the specific coded areas on the marker 10 in order to designate any required number from 1000 to the number 1777.

With continuing reference to FIG. 2, the key coded area 20 also includes two optional transparent circular areas therein. These areas of transparency may be used to indicate further major coding designations in any of the coded areas. This major coding may be used for such purposes as indicating the year in which the item was coded or created or the owner of the item, etc. While transparent circular shapes have been designated as examples in FIG. 2, it will be obvious to one skilled in the art that other various geometric and alphanumeric shapes may also be used as required. The advantage of using shapes rather than numbers is that the shapes may be more recognizable in conditions of low light. This increases the number of potential codes to an extremely large number.

With continuing reference to FIGS. 1 and 2, the majority of the coded areas have been arranged adjacent to the circumference of the marker 10 in order to minimize the areas of separation therebetween. It should be understood that additional shapes of the base 12 may be utilized without departing from the scope or spirit of the present invention. For example, a rectangular base 12 may be utilized with the coded areas arranged along the perimeter thereof. Regardless of the shape of the marker 10, the key coded area 20 must in some way indicate the indexing point or starting point from which all binary numbers are measured. As illustrated in FIG. 1, the key coded area 20 is always painted with an opaque substance and is always rectangular in shape to indicate that the order of ascending octal importance proceeds in a circular direction which originates perpendicular to the longer direction of the key coded area 20. Thus, even if the marker 10 is upside down as it is viewed, the observer merely proceeds in the circular direction, either clockwise or counter clockwise, which is perpendicular to the longest axis of the key coded area 20.

While the first preferred embodiment of the present invention as shown in FIGS. 1 and 2 is illustrated with a transparent base 12 and opaque coded areas for indicating the binary 1, it will be understood that reverse imaging may also be used such that the base 12 is opaque and the coded area are made transparent in order to designate the binary 1 for that octal location. However, regardless of the coding strategy, the coded areas each should be substantially homogeneous in their markings so as to improve the visual recognition as opposed to the conventional systems which employ alpha-numeric symbols which are often difficult to read under conditions of inadequate illumination.

The markers are manufactured by a photoreduction process which is generally the same as is used in the semiconductor industry. A large master design is prepared having the appropriate coded information thereon. This master is then photographically multiplied and reduced for producing a large scale master. Typically there will be 35 markers or labels per linear inch, and the markers can be manufactured in a sheet of approximately 8 by 10 inches or larger. The markers may then be cut into members or strips having a single or relatively few markers in width. These strips may then be loaded into cartridges for use with an appropriate application apparatus. The dimensions of the typical marker can be reduced using existing technology to a size only 0.001 inches by 0.001 inches, but this size is not ordinarily preferable since unaided visual decoding is impossible and the required optical decoding equipment becomes more expensive than the typical ten-power inspection microscope that is envisioned for use with the preferred embodiment present invention.

While it is envisioned that the first preferred embodiment of the present invention may be viewed and decoded directly by the naked eye, or more preferably by using a ten-power magnifying glass or microscope, it may also be advantageous to provide a manual pocket decoder for the inskilled operator who is required to infrequently decode the numbers contained upon the marker 10 and who is not familiar or comfortable with the use of octal based numbers. Therefore, as illustrated in FIGS. 4 and 5, a first preferred embodiment of a manual decoding device has been provided.

The manual decoder 50 includes an upper planar surface 51 and a lower planar surface 52 for defining therebetween a void 53. The upper planar surface 51 is arranged to correspond precisely with the visual appearance of the indicia on the marker 10 as illustrated in FIG. 1. The appropriate coded or digital areas 20 through 29 are provided with cutouts or slots in the upper surface 51. A plurality of digital sliding members are provided, with each sliding member being paired with an appropriate slot and located immediately subjacent thereto and retained between the upper surface 51 and the lower surface 52. For example, a sliding member 41 is provided immediately below but paired with the slot 61, and so forth for all of the coded areas. Each of the sliding members include an upstanding member which communicates through the appropriate slot for being engaged by the finger of the operator. The sliding member then may be moved outwardly in order to reveal on the upper surface thereof a numeral corresponding to the weighted value of the particular coded area which has been chosen. With the exception of coded area 28 and sliding member 48 which require an extension as illustrated in FIG. 5, each of the sliding members 41 through 49 extend from the perimeter of the base 12 at a point immediately adjacent to the corresponding slot.

Octal coding lines 56, 57 and 58 are provided on the upper planar surface of the manual decoder 50 in order to visually separate the coded areas into the appropriately weighted octal digits. In this manner the operator may read the extended numbers around the periphery of the manual decoder 50 and each of the numerals appearing on the extended sliding members may be added in order to determine the decimal representation of the coded number. An arrow may be included on the upper surface 51 of the manual decoder 50 to indicate the proper direction for reading and decoding the device.

It is envisioned that the first preferred embodiment of the label or marker 10 in accordance with the present invention may be secured to the surface of the item to be marked either by placing the marker 10 within a small or slight recess in the surface of the item or by merely placing the marker 10 on the outer surface or any other desired visible surface of the item. In either case it is strongly advisable to provide some type of adhesive or film covering in order to prevent the marker 10 from being removed from the item and to protect the item from exposure to destructive environmental elements.

An applicator apparatus, shown generally as 70 in FIG. 3, in accordance with the present invention is provided for receiving and applying the markers 10 upon the item to be marked. The applicator apparatus 70 includes a base section 74 having a first end 71 and a second end 72. A storage cassette 76 or reel (not shown) is removably coupled to a mid-section of the base 74, and receives therein a plurality of strips 110 of the markers 10. An optical sighting apparatus 78 is mounted adjacent to the cassette 76 for allowing the operator to site through the upper end thereof for placing one of the markers 10 in precise registration with the base. A rotatable drive wheel 80 is mounted adjacent to an upper surface of the base 74 for engaging the marker strip 110, and as the wheel 80 rotates in counterclockwise direction the marker strip 110 will be moved toward the first end 71 of the base 74.

As illustrated in FIG. 3, as one of the markers 10 in the marker strip 110 is extended beyond the first end 71 of the base 74, a guillotine-type cutter 82 is forced downward so that an inside edge 83 thereof cooperates with the first end 71 of the base 74 to shear off one of the markers 10. If the marker strip 110 has been placed in precise registration with the base 74 by the proper sighting within the sighting apparatus 78, then a single marker 10 will be deposited upon the item to be marked at a position immediately adjacent to the first end 71 of the base 74. The marker 10 is retained within a concave shaped recess 86 in the lower surface of the cutter 82 which moves into communication with the surface of the article to be marked. A shield 84 surrounds the guillotine cutter 82 and the first end 71 of the base 74 in order to prevent ambient winds or breezes from blowing the small marker 10 from its desired position on the item to be marked.

Immediately after the guillotine cutter 82 severs the marker 10 from the marker strip 110, a spray of adhesive substance is expelled onto the marker 10 from a tube 90 which communicates through an upper surface of the guillotine cutter 82. This tube communicates with an adhesive storage reservoir 92 which is compressable by a downward moving member 94. It is envisioned that power for rotating the wheel 80, for operating the guillotine cutter 82 and for compressing the adhesive storage reservoir 92 may be obtained through a gear box 96 which is actuated through a linkage arm 97 which in turn is actuated by the operator grasping and squeezing a movable handle 98.

It will of course be apparent that other forms of the applicator apparatus 70 may be used with equal effectiveness in removing one marker 10 from a strip of markers 110, depositing this marker 10 on the item to be marked, and then depositing a film of adhesive material over the marker 10.

It has also been determined that the visibility of the marker 10 as applied to the item may be improved by combining with the adhesive substance a material which has fluorescent qualities. If the covert nature of the marking system 10 is unimportant to the user, then a continuously iridescent or brightly colored material may be mixed with the adhesive substance in order to provide additional assistance for the operator in locating the marker 10. However, if the covert nature of the marking system is to be preserved, the fluorescent substance should respond or be visible only through the use of a specialized light source, such as ultraviolet light or infrared light. In this manner an optical viewer may be developed which employs a magnifying glass together with the decoding light source for illuminating the fluorescent adhesive material in order to assist the operator in locating the marker 10. One additional advantage which has been found in using the fluorescent adhesive material is that the back lighting effect of illuminating the fluorescent material behind the marker 10 assists the operator in distinguishing the transparent from opaque sections of the marker 10. Furthermore, if cutouts or other additional alpha-numeric figures are placed upon the marker 10 (such as within the key coded area 20 as shown in FIG. 2) the visibility of these additional markings is greatly enhanced through the use of the fluorescent adhesive material.

The operation of the first preferred embodiment of the applicator apparatus and the marking system will now be explained with reference to FIGS. 1 and 3. First, the marking strips 110 containing the plurality of markers 10 are loaded within the storage cassette 76 or reel and fed through the sighting apparatus 78, the drive wheel 80 so as to be in proper registration therewith. The operator merely grasps the handle 98 and lowers the base 74 of the apparatus into communication with the surface of the article to be identified. As the operator squeezes the handle 98 the guillotine-type cutter 82 is forced downwardly so as to shear off the marker 10 which has been advanced beyond the first end 71 of the base 74. The single marker 10 is restrained within the recess 86 in the lower surface of the cutter 82 since a lower circumferential surface thereof will communicate closely with the surface of the article to be marked. A spray of a liquid sealant or adhesive substance is directed from the top of the concave shaped recess 86 in the cutter 82 so as to force the severed marker 10 in a downward direction toward the surface of the article to be marked. The pressurized spray of the sealant or adhesive material is directed over a wide angle in order to deposit a relatively thick and evenly disbursed coating which will provide a weatherproof seal over the surface of the article to be identified and the marker 10 which is juxtaposed therewith. The size of the area which is sprayed with the sealant material will generally be much larger than the size of the marker 10.

Thus, a first preferred embodiment of the marking system and an applicator apparatus therefore has been described as an example of the invention as claimed. However, the present invention should not be limited in its application to the details illustrated in the accompanying drawings of the specification, since this invention may be practiced and constructed in a variety of different embodiments. Also, it must be understood that the terminology and descriptions employed herein are used solely for the purpose of describing the general operation of the preferred embodiment and the method disclosed therein and therefore should not be construed as limitations on the operability of the invention.

I claim:

1. A micro-marking label to be applied to articles for identification, comprising:

a micro-sized plate of such size so as to be substantially invisible to casual observation when juxtaposed with the article to be identified;

identification indicia comprising a plurality of adjacent digital areas generally arranged about the periphery of an exposed surface of said plate, with each of said digital areas being precharacterized in one of a first optical condition and a second optical condition for identifying a digital bit of data; and a substantially transparent sealant coupled over said exposed surface of said plate and onto the article to be identified for covering and sealing said plate, with said exposed surface visible, to the adjacent surface of the article to be identified, whereby upon close examination said digital areas comprising said identification indicia upon said microsized plate may be sequentially interpreted in order to digitally decode the message thereon.

2. The micro-marking label as described in claim 1 wherein said digital areas include a key digital area and a plurality of data digital areas sequentially adjacent thereto, with said key area being larger in size than said digital areas.

3. The micro-marking label as described in claim 2 wherein:

said microsized plate is formed of a substantially transparent material; and wherein each of said digital areas in said first optical condition are characterized as transparent, and wherein each of said digital areas in said second optical condition are characterized as homogeneously opaque to the passage of light therethrough.

4. The micro-marking label as described in claim 3 wherein said key digital area is generally opaque and includes therein transparent apertures having predetermined alpha-numeric form for communicating additional information to the viewer.

5. The micromarking label as described in claim 1 wherein said digital areas include a single generally opaque key digital area of larger size and a plurality of smaller digital areas arranged in sequence and generally continuously about the entire periphery of said exposed surface of said plate, so as to be readable with the unaided eye.

6. The micromarking label as described in claim 5 wherein said plate is relatively thin and further defines a coupling surface on the opposite side thereof from said exposed surface, with said coupling surface for being juxtaposed with the article to be identified as said transparent sealant covers said exposed surface of said plate and the article to be identified.

* * * * *